United States Patent [19]

Christensen et al.

[11] 3,998,402

[45] Dec. 21, 1976

[54] HAND WINDING DEVICE

[75] Inventors: Lyle E. Christensen, Kingston; C. Dana Soucie, North Hampton, both of N.H.

[73] Assignee: BeMor International, Inc., North Hampton, N.H.

[22] Filed: Apr. 19, 1976

[21] Appl. No.: 678,204

[52] U.S. Cl. ..... 242/106; 242/60

[51] Int. Cl.[2] ..... B65H 17/52

[58] Field of Search ..... 242/67.1 R, 60, 96, 242/106, 55.3

[56] References Cited

UNITED STATES PATENTS

| | | | |
|---|---|---|---|
| 71,047 | 11/1867 | Bonk | 242/55.3 |
| 437,554 | 9/1890 | Bellamy | 242/60 |
| 766,098 | 7/1904 | Brown | 242/60 |
| 788,133 | 4/1905 | Harrison | 242/106 |
| 1,359,021 | 11/1920 | Blair | 242/60 |

*Primary Examiner*—Edward J. McCarthy
*Attorney, Agent, or Firm*—Lee A. Strimbeck

[57] ABSTRACT

A handicraft device for winding strips of sheet material such as paper into tubes or beads with hollow cores comprises two upright members supporting a plurality of winding spindles each of a different diameter and having a finger operable crank handle at one end. A spindle may be removed by sliding it out of the upright. The uprights are fixed into a mounting means adapted to attach the device to the edge of a tabletop. In operation only one winding spindle of the desired diameter can be used at a time, the others being removed and set aside. The device is principally characterized by the fact that it is made of snap-together molded plastic elements.

4 Claims, 5 Drawing Figures

FIG. 1
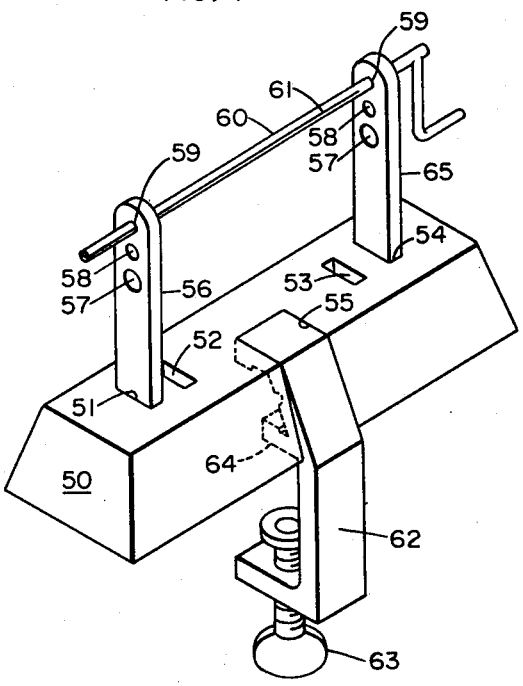
FIG. 2
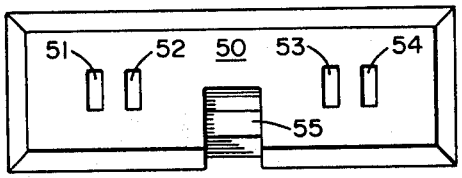
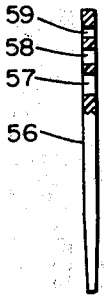
FIG. 3
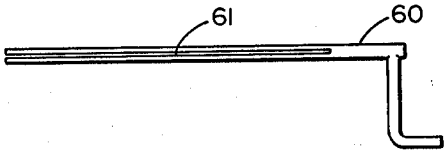
FIG. 4
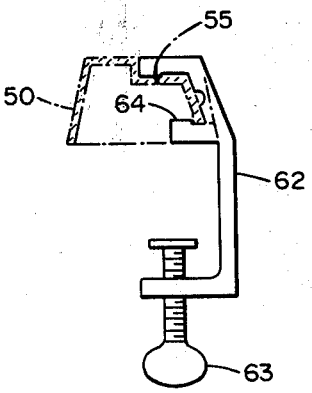
FIG. 5

HAND WINDING DEVICE

The present invention is a winding device for hand rolling decorative beads and tubes from flexible sheets of materials such as paper, metal foil and plastic. The beads so produced may be threaded to form jewelry such as necklaces, curtains, wrist bracelets and earrings. The beads can be used for decorative touches in macrame, in holders for hanging planters, and for lamp fringes and lapel ornaments. Some form of adhesive such as a water soluble glue is normally used to hold the tubes of the sheet material together after they are rolled.

DRAWINGS

In the drawings:

FIG. 1 is a prospective view of one embodiment of the device of this invention showing but one winding spindle in place.

FIG. 2 is a top view of the base.

FIG. 3 is a front view of one of the uprights of the device of FIG. 1.

FIG. 4 is a view of one of the winding spindles of the device.

FIG. 5 is a side view of the detachable mounting clamp of the device with the base being shown in section-shadow outline to illustrate how the clamp attaches thereto.

DESCRIPTION

With reference to FIGS. 1–5 the handicraft device is shown. It is principally characterized by the fact that it is made of molded plastic elements which snap together. A base of a molded plastic is shown at 50. Base 50 has preferably a configuration of hollow box with some depth between its top and bottom surfaces.

A snap-on clamp attaching to base 50 is shown at 62. Clamp 62 is to mount the base 50 to a work surface such as the edge of a table top. Two uprights are shown at 56 and 65. These uprights force-fit into suitable holes or sockets 51, 52, 53 and 54 in base 50. As illustrated base 50 and the sockets have considerable depth which give support and mounted rigidity to the uprights 56 and 65. The uprights are preferably at least 1.50 inches apart. As shown the uprights are in the widest apart openings 51 and 54.

The uprights 56 and 65 have holes therein, 57, 58 and 59 of different diameters to accommodate two or more winding spindles, each of a different diameter. Only one winding spindle 60 of the smallest size is shown in place in holes 59 in the upright.

Base 50 has in its approximate middle a slot 55 mating with and accommodating the upper end bar of clamp 62. Clamp 62 is in the shape of a C-clamp and has at its lower end a thumb screw 63 adapted to engage the underside of the tabletop. It is convenient for clamp 62 to have a horizontal arm 64 as shown in FIG. 5 and base 50 to have a mating slot therefor on its underside so that clamp 62 can snap fit under the edge of base 50 and be carried therewith without falling off.

With reference to FIG. 4 pin 60 can be of single-piece construction and molded of a plastic having surface lubricity such as a polyamide (nylon) or a polytetraflorolethylene. If the plastic has surface lubricity, then it is usually not necessary to oil the surface of the spindle in order to permit the wound bead to be removed or slid off. The pins are preferably split longitudinally as shown at 61 to permit inserting of the material to be wound at the beginning of the winding operation.

The spindles are rods of uniform cross-section over their length so that they can be rotated in and be withdrawn through the mating holes in the uprights. Each spindle is of a different size so that beads of different sized cores can be made. As the spindles are split along the length thereof, they in fact can be metal cotter pins.

In operation only one spindle is used and the others are removed and set aside. The one used is selected to give the size of hole desired in the bead. The spindle is generally horizontal in use. If paper sheet material is to be used, then it is cut into strips, preferably triangular in shape. The slope of the sides of the triangular shape helps determine the shape of the bead or tube to be produced and the height or length thereof determines the diameter or bulk of the bead. The wide end of the triangle shape is inserted in the slot in the spindle and it is rotated once or twice. A couple of drops of a binder such as a casein glue, a shellac or a lacquer are then placed on the sheet next to the spindle and the spindle is turned to wind up the sheet into the bead with a couple more drops of binder being applied at the end of the strip to affix it in place. The finished bead is then pulled off the spindle. If sticking is encountered, the spindle may be lubricated before winding by dipping into a detergent or vegetable oil.

In some instances it may be desirable to form the wound object on the end of pin 60 outside of the uprights. To do this the uprights can be seated in the more closely spaced holes 52 and 53 or in a pair of adjacent end holes in base 10 such as 53 and 54. So arranging the uprights will leave a considerable amount of the pin projecting at one end.

What is claimed is:

1. A handicraft device adapted to the winding of a strip of sheet material comprising two vertical-in-use, elongated and facing support members spaced at least 1.5 inches apart and having matching holes in the upper ends thereof adapted to support at least two winding spindles, each of a different diameter; a winding spindle adapted to be removably mounted for rotation in one pair of said matching holes, said winding spindle having a finger-operable crank handle on one end thereof and having a longitudinal split therein adapted to accommodate one end of said strip; a base of a molded plastic and having a pair of sockets adapted to receive and mount said support members and having a slot therein adapted to receive a mounting clamp; and a mounting clamp adapted to fit on to said base with the upper end of said mounting clamp mating with said slot and adapted to affix the base to the edge of a table.

2. The handicraft device of claim 1 wherein said mounting clamp has a C-clamp configuration and is also made of a molded plastic and wherein the lower end of said mounting clamp carries an upwardly acting thumb screw adapted to engage the underside of said edge.

3. The handicraft device of claim 1 wherein said support members and said winding spindle are also of molded plastic and wherein the plastic of said winding spindle has surface lubricity properties.

4. The handicraft device of claim 1 wherein said base has the configuration of a hollow box of some thickness and said pair of sockets are of considerable depth.

* * * * *